United States Patent [19]

McKechnie

[11] Patent Number: 4,858,931

[45] Date of Patent: Aug. 22, 1989

[54] ELECTRONIC DICE

[76] Inventor: Ian C. McKechnie, 8524 N. 50th Pl., Scottsdale, Ariz. 85253

[21] Appl. No.: 676,201

[22] Filed: Nov. 27, 1984

Related U.S. Application Data

[63] Continuation of Ser. No. 289,726, Aug. 3, 1981, abandoned.

[51] Int. Cl.[4] ..... A63B 71/00

[52] U.S. Cl. ..... 273/138 A; 273/58 G

[58] Field of Search ..... 273/121 A, 138 A, 58 G, 273/58 F; 46/232; 200/153 C

[56] References Cited

U.S. PATENT DOCUMENTS

| | | | |
|---|---|---|---|
| D. 220,503 | 4/1971 | Church | 273/138 A |
| 2,849,819 | 9/1958 | Murphy et al. | 273/58 G |
| 3,357,703 | 12/1967 | Hurley | 273/138 A |
| 3,459,427 | 12/1969 | Rhodes | 273/138 A |
| 3,592,473 | 7/1971 | Jernakoff | 273/138 A |
| 3,709,499 | 1/1973 | Lukens | 273/138 A |
| 4,124,881 | 11/1978 | Haber | 273/138 A |
| 4,213,524 | 7/1980 | Miyashita | 273/138 A |

FOREIGN PATENT DOCUMENTS

| | | | |
|---|---|---|---|
| 383237 | 12/1964 | Switzerland | 273/138 A |

OTHER PUBLICATIONS

*Popular Electronics,* Sep. 1967, pp. 29–34, Lancaster, Don, "Spots Before Your Eyes".

*Primary Examiner*—Edward M. Coven
*Attorney, Agent, or Firm*—Warren F. B. Lindsley

[57] ABSTRACT

An electronic device actuated by a manually generated movement to generate two independent and random set of electronic pulses resulting in a display of two independent sets of dots or digits from one to six inclusive representative of a dice display.

1 Claim, 4 Drawing Sheets

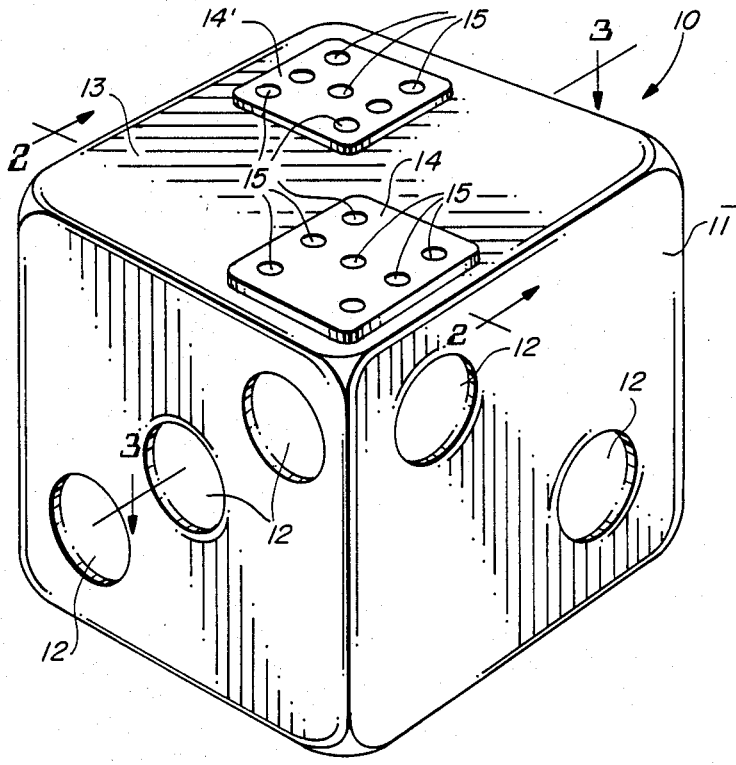
FIG. 1
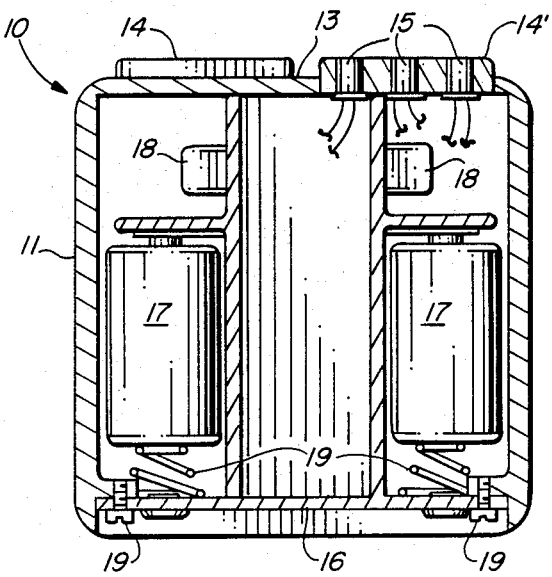
FIG. 2
FIG. 3
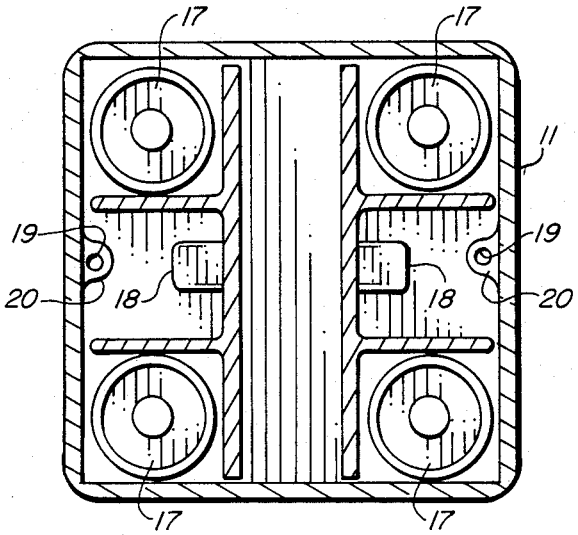
| PULSE NO. | COUNTER | | | | DECODER | | | |
|---|---|---|---|---|---|---|---|---|
| | IN | OUT | | | OUT | | | |
| | CL | A | B | C | a | b | c | d |
| 1 | 0 ↗ 1 | 1 | 0 | 0 | 1 | 0 | 0 | 0 |
| 2 | ↗ | 0 | 1 | 0 | 0 | 1 | 0 | 0 |
| 3 | ↗ | 1 | 1 | 0 | 1 | 1 | 0 | 0 |
| 4 | ↗ | 0 | 0 | 1 | 0 | 1 | 1 | 0 |
| 5 | ↗ | 1 | 0 | 1 | 1 | 1 | 1 | 0 |
| 6 | ↗ | 0 | 1 | 1 | 0 | 1 | 1 | 1 |
| 7 | ↗ | 1 | 0 | 0 | 1 | 0 | 0 | 0 |
FIG. 5

FIG. 10
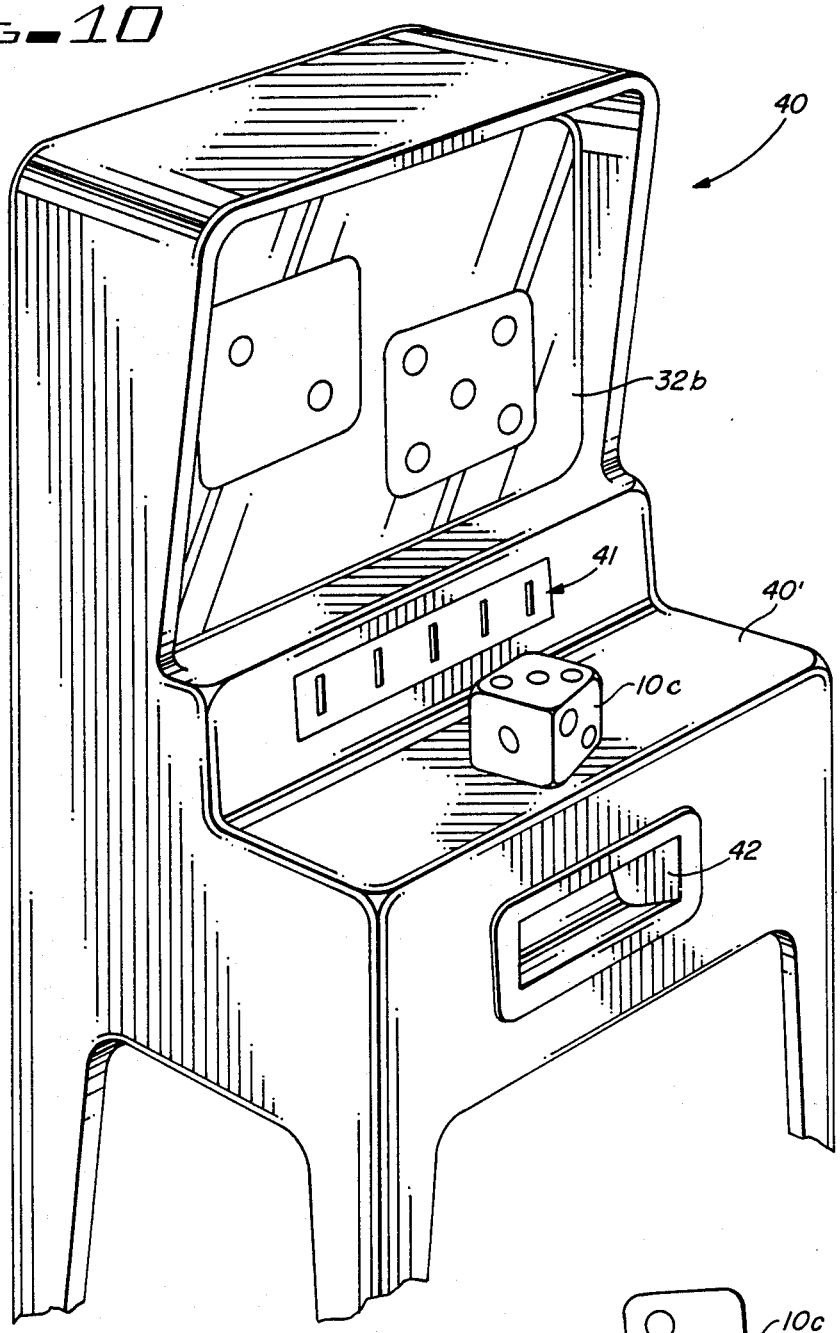
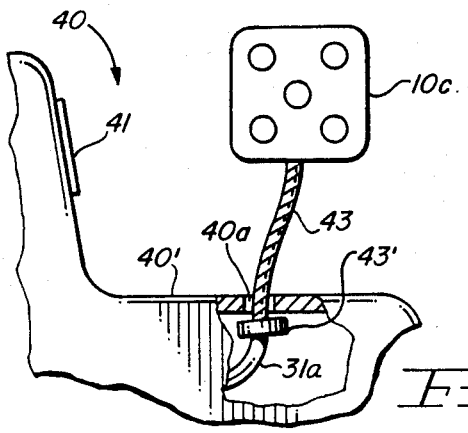
FIG. 11
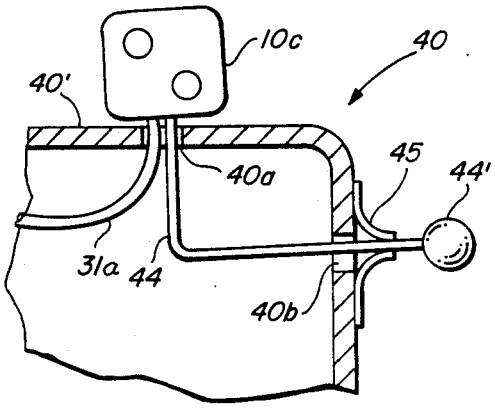
FIG. 12

ELECTRONIC DICE

This is a continuation of Ser. No. 289,726 filed Aug. 3, 1981, now abandoned.

BACKGROUND OF THE INVENTION

Dice have been known since the days of the Palamedes (circa 1,244 B.C.), but the use of cubes with numbered sides for gambling purposes is probably much earlier in time. There is no period in history and no nation in which some form of dice has not been used. Dice depicted on the early Egyptian monuments excavated at Thebes can scarcely be distinguished from the dice made today and their use is attested by laws regulating the games played with them in ancient Greece and Rome, as well as in most European countries.

DESCRIPTION OF THE PRIOR ART

The known dice comprises a small cube. On each of its six sides is placed a number ranging from one to six. The sum of the two numbers on the opposite sides of a dice is always seven, thus if six is at the top, one is at the bottom and so on.

Usually, one, two, three or five dice are used in many games with the dice placed in a cylindrical box about four inches high and from one and a half to two inches in diameter. The box, open at the top, is shaken and turned up quickly so that the dice will fall flat on a table. The aggregate amount of the spots uppermost at each throw are summed up and placed to the score of the thrower.

Various other gambling games are played by throwing the dice, including electronically and mechanically operated games that simulate the throwing of a pair of dice.

One such gambling game uses a conventional slot machine having three reels. The machine pays off when the two dice faces that show up on one reel matches the dice faces that show up on the other two reels.

Another known game uses an actual pair of dice mounted on a vibrated platform which momentarily, by action of the operator, causes the dice to jump up and down in random fashion. A bet previously made by the operator is paid by the machine if the resulting display of the dice corresponds with the bet.

SUMMARY OF THE INVENTION

In accordance with the invention claimed, a new and improved electronic device is provided that produces the same random results obtained by throwing an actual pair of dice. The device may have several different physical forms for displaying the results, but in all such forms, the operator, by manual action, creates two independent and random sets of electronic pulses that result in the display of two independent sets of either dots or digits from one to six inclusive.

It is, therefore, one object of this invention to provide a new device employing dice digits.

Another object of this invention is to provide a new and improved electronically actuated dice resulting in a randomly produced display.

A further object of this invention is to provide a new and improved electronic dice, the display of which may be remotely located.

A still further object of this invention is to provide a new and improved gambling table, the display of which is randomly changed by a dice movement.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 1 is an exterior perspective view of one form of a self-contained dice-like device, the display of which is electronically controlled;

FIG. 2 is a cross-sectional view of FIG. 1 taken along the line 2—2;

FIG. 3 is a cross-sectional view of FIG. 1 taken along the line 3—3;

FIG. 5 is a truth table showing the display sequence obtained by shaking the device;

FIG. 10 is a further modification of a gambling table employing a randomly movable dice;

FIG. 11 is a view partially in cross-section illustrating one way of connecting the dice like device to the gambling table of FIG. 10; and FIG. 12 illustrates a modification of the means of connecting the dice like device of FIG. 10 to the gambling table and random movement thereof.

DESCRIPTION OF THE PREFERRED EMBODIMENT

Figure 4:
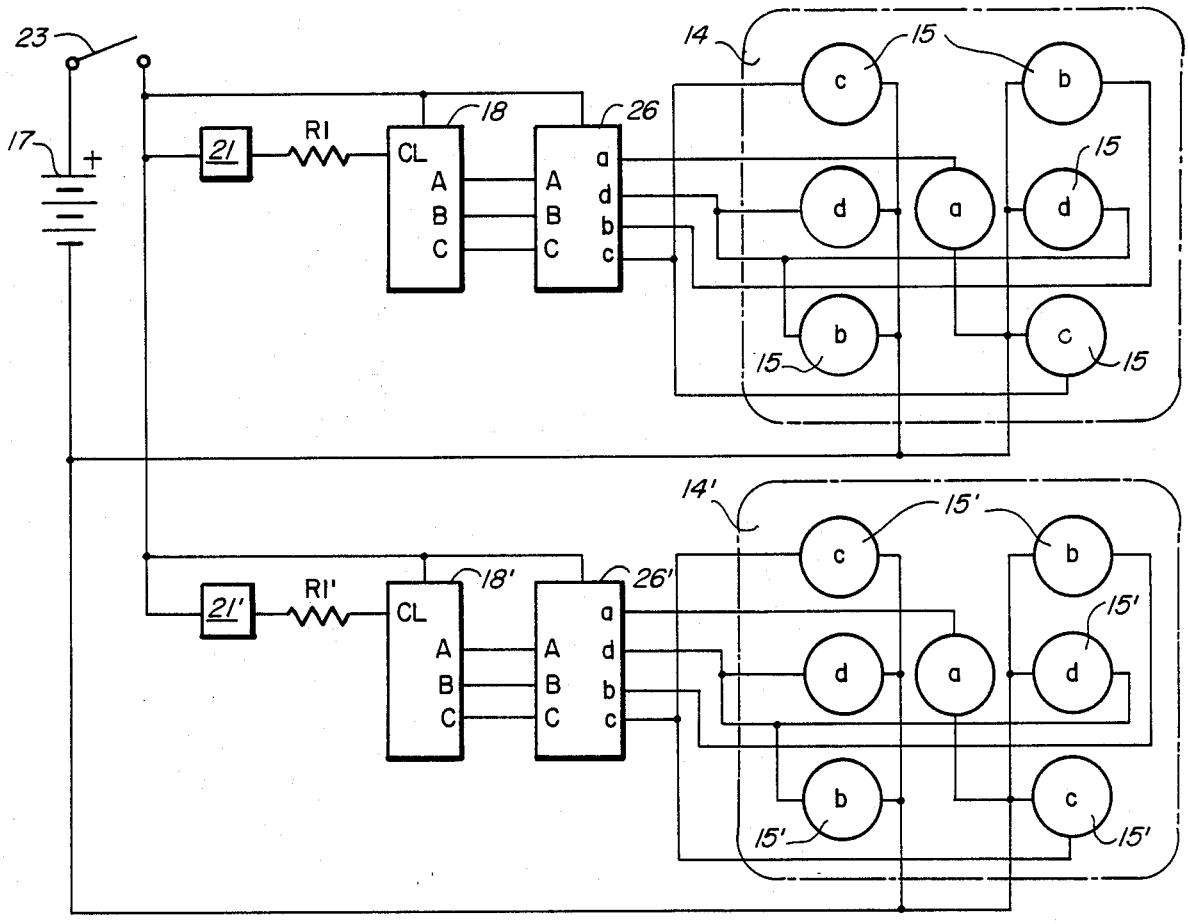
FIG. 4 is a schematic view of the components shown in FIG. 1.

Referring more particularly to the drawings by characters of reference, FIG. 1 discloses a dice device 10 comprising a hollow shell-like cubical configuration or housing 11 having four exposed sides and a top. The sides are provided with spots 12 of contrasting color to represent the spots on the face of the known dice. The top or upper surface 13 of the device is provided with two identical rectangular display sections 14, 14' with each section having seven light emitting devices 15 mounted therein.

FIGS. 2 and 3, which are different cross-sectional views of FIG. 1, illustrate that the cubical configuration contains a compartmentalized framework 16 for housing dry cell batteries 17, integrated circuits 18, 18' comprising counters and other circuit components, hereinafter described. This entire framework 16, together with its housed components, are supported within the cubical configuration 11 by a plurality of screws 19 extending through the base of the framework 16 and into bosses 20 which may be formed integral with the cubical configuration 11.

FIG. 4 is a schematic illustration of the circuit configuration of device 10 wherein each of the rectangular display sections 14, 14' are energized from batteries 17 by a separate circuit comprising inertia or mercury switches 21, 21', resistors R1 and R1', counters 18, 18' and decoders 26, 26'. Batteries 17 and the on/off switch 23 are common to each of the display sections 14, 14' and all are mounted within the framework 16 of shell 11.

OPERATION OF THE INVENTION

With reference to FIG. 4, when device 10 is energized by the closure of switch 23, display sections 14, 14' will light some of the dots formed by the light emitting devices 15, 15'. Upon manually shaking device 10, random pulses are delivered to the input terminals CL of counters 18, 18' by intermittent contact made in the inertia switches 21, 21'. Each make and break of the contacts in each of the inertia switches 21, 21' results in advancing the count in its respective counter 18, 18'. This count, in turn, is decoded by decoders 26, 26' and results in decoder outputs that cause the appropriate light emitting devices 15, 15' of each display section 14, 14' to light or glow.

FIG. 5 is a truth table showing the sequence in which the pulses caused by the make and break of contacts in inertia switches 21, 21' result in lighting up the associated light emitting devices 15, 15'. It should also be understood that although the truth table of FIG. 5 shows the count proceeding from one up through six and back again to one, to repeat the cycle, regardless of the number of pulses generated, it may be desirable, in the interest of insuring a random result, to reverse the counting sequence in one of the counters 18 or 18'. In this case, one of the counters 18 or 18' will count up from one through six and repeat, while the other counter will count down from six through one and repeat. Since the two intertia switches 21, 21' are independent of each other, the resulting display in each display section 14, 14' will be random and independent of each other when the shaking ceases.

Figure 6:
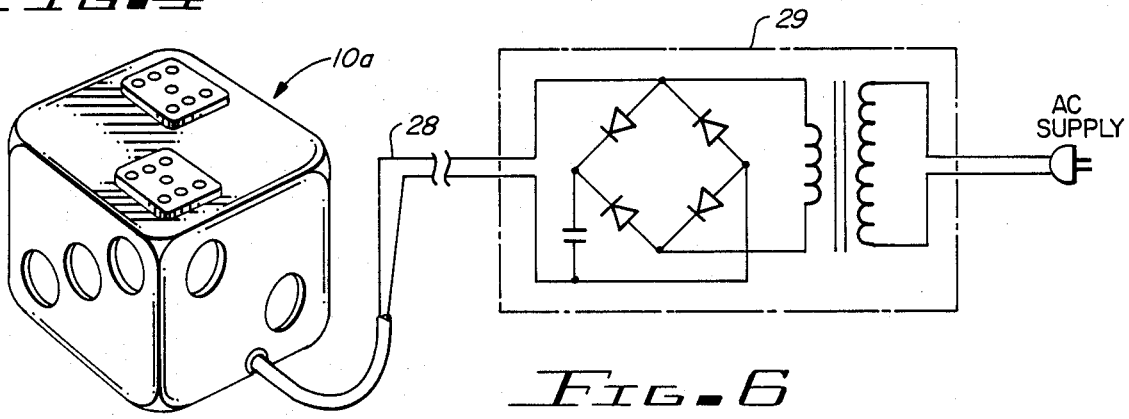
FIG. 6 is a modified form of the device shown in FIG. 1 wherein the power supply for the dice is remotely located.

FIG. 6 shows a smaller and lighter device **10*a*. This device is the same as the device 10 of FIG. 1 except the batteries 17 have been replaced with a conventional converter 29 which is connected to device 10*a* by cable 28. Device 10*a*** is now powered by the AC supply from the local utility.

Figure 7:
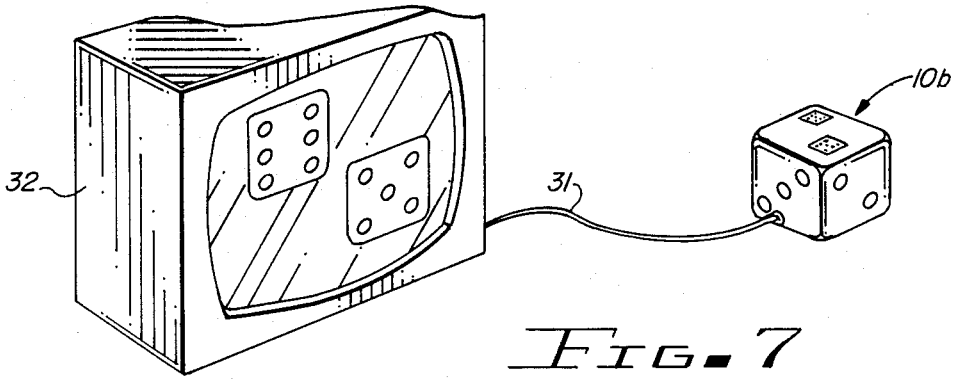
FIG. 7 is a further modification of the device shown in FIGS. 1 and 6 wherein the display of the dice is remotely located from the device manipulated by the operator.

FIG. 7 shows device **10*b* connected by cable 31 to display unit 32. Display unit 32 may be a TV screen or any other suitable display unit. Power to device 10*b* may also be obtained from the display unit 32 via cable 31**.

Figure 7A:
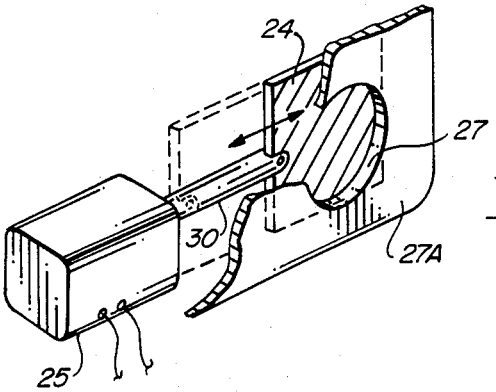
FIG. 7A illustrates a modification of the display means shown in FIGS. 1–7.

FIG. 7A illustrates a further means for exposing a colored or illuminated surface 24 that may be used in place of the light emitting devices 15. In this instance, a magnetic coil 25 my means of its plunger 30 moves surface 24 to and from an exposing aperture 27 formed in the surface 27A of the display unit. The magnetic coil 25 is actuated by decoder 26 or 26'.

Figure 8:
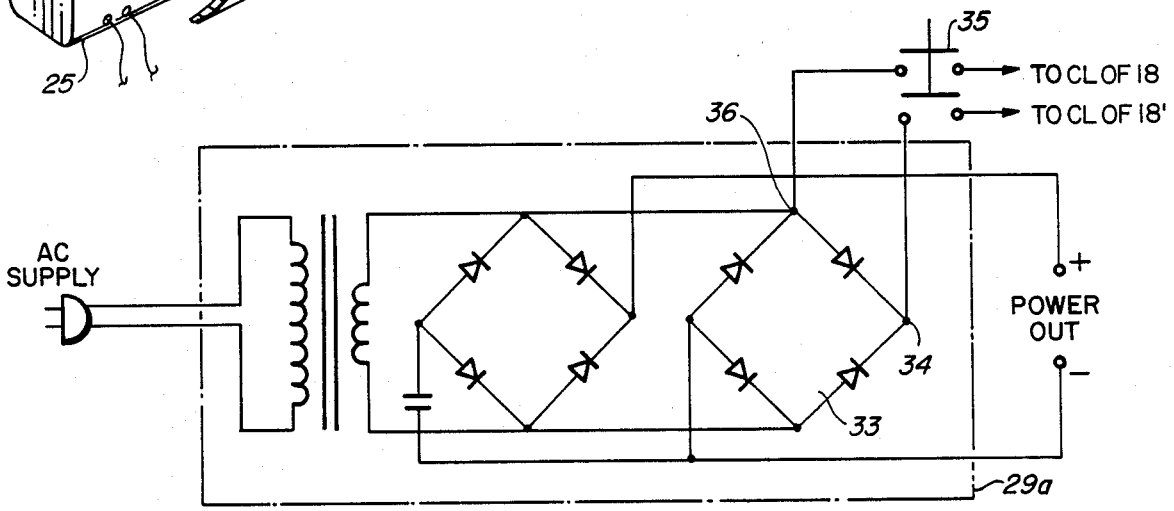
FIG. 8 is a circuit diagram of a still further modification of the invention wherein a switch obviates the need for shaking the device while still randomly producing the resulting display.

FIG. 8 illustrates a schematic of an AC to DC converter **29*a* to which has been added a second full wave rectifier 33. Two separate pulse frequencies can now be obtained from this converter 29*a*. The incoming frequency of the AC line is obtained at terminal 36 comprising 60 cycles for a 60-cycle supply. Double the incoming frequency is obtained at terminal 34 or 120 cycles for a 60-cycle supply. These two frequencies are then fed to the input of the two separate counters 18, 18' by manually closing spring return push switch 35 momentarily as in FIGS. 6 and 7 by the connecting cable. This again results in a random and independent display on display sections 14, 14' or 32 when switch 35 is released. This arrangement may replace inertia switches 21, 21' of FIG. 4 with each of the output terminals of switch 35 being connected to one of the input terminals CL of the counters 18, 18'** thereof.

Figure 9:
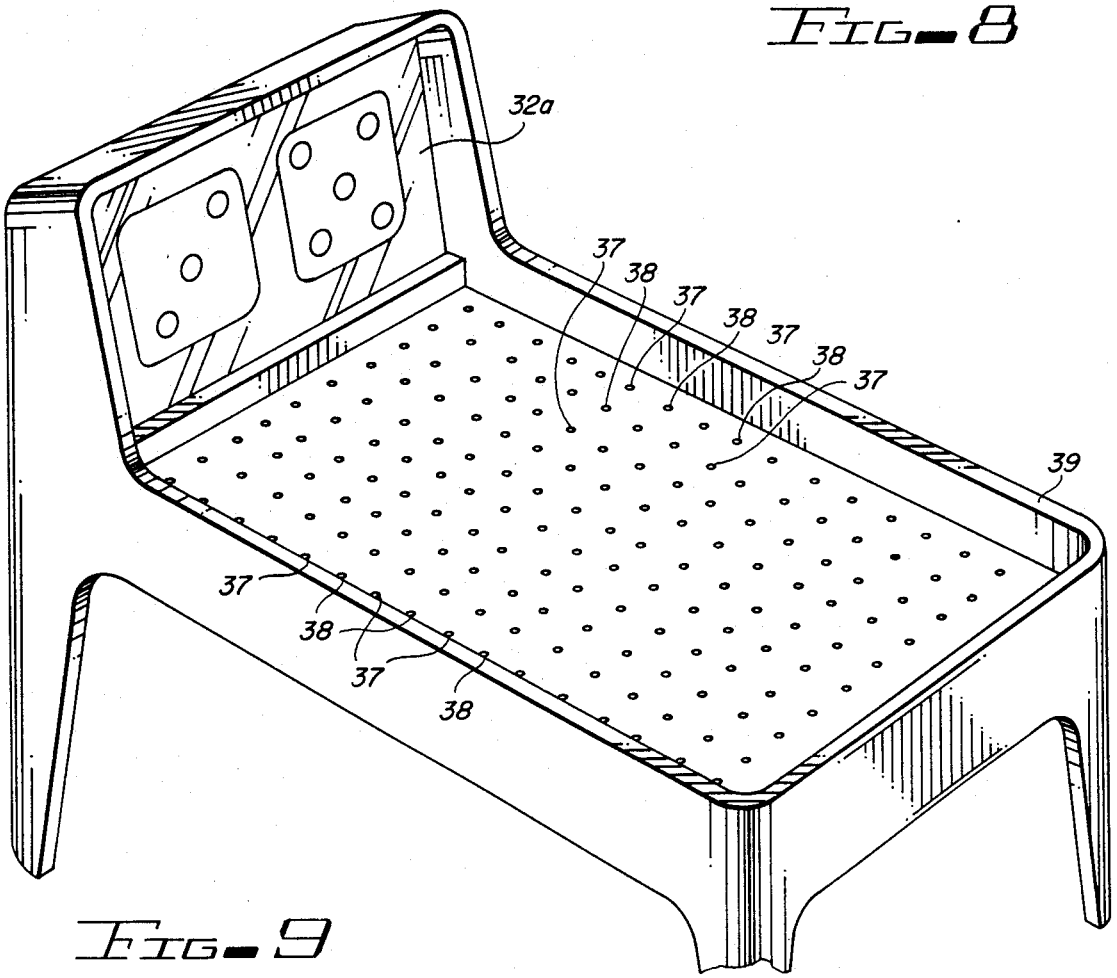
FIG. 9 is still a further modification of the invention illustrating a sensitized table top or platform over which a pair of cubes without spots are thrown to produce on a display random results of a particular dice configuration.

Many other methods of producing a dual series of random and independent pulses by periods of manual action, which are fed to the input of two separate counters 18, 18', are possible. One such method is shown in FIG. 9 wherein a matrix of sensors 37 and 38 are embedded just under the top surface of a table 39. Sensors 37 are located alternately with sensors 38 in the matrix and are associated with one counter 18 of a display section. Sensors 38 are associated with the other counter 18'.

Sensors 37 and 38 may be of the photo detector type in which case their ohmic resistance changes from a very low value, when exposed to light rays, to a very high value when the light rays are interrupted. Thus, when the matrix is supplied with power and the output of each photo detector 37 is connected to a common bus and in turn to input terminal CL of one counter 18, the passage or rolling of dice across table 39 will interrupt light rays to any sensor 37 over which a dice passes when the source of light rays is located above table 39. This creates a pulse that is fed into counter 18. Likewise, the same result occurs in each sensor 38 and produces a pulse fed to the other counter 18'. The resulting count is then decoded by decoders 26 and 26' and displayed on unit **32*a* of FIG. 9**.

Sensors 37 and 38 may alternately be of the Hall effect type in which, when supplied with power, turns on and off, thus producing pulses with the passage of magnetic poles of a magnet. In this case, the dice thrown across table 39 are magnetized to be permanent magnets. Other type sensors, such as pressure sensitive transistors and proximity switches, may also be used.

It should be noted that reference has been made to the display as having light emitting devices that are a series of dots. By the use of conventional BCD decoders in place of decoders 26 and 26' and seven segment light emitting diode displays in place of display sections 14 and 14', the displayed result will take the form of two actual digits from one through six inclusive.

Several forms of this device may be used in gambling casinos, in which case an associated machine accepts bets as in a conventional dice game. The gambler then "throws the dice" by shaking a unit containing the two inertia switches 21 and 21'. The machine pays off if the gambler is successful. The display sections 14 and 14' may be incorporated either in the device the gambler shakes, the betting machine, or both.

FIGS. **10*b* and 11 disclose a gambling machine 40 having a display unit 32*b* built into it in a viewing position and a substantially horizontally positioned playing surface 40'. A dice device 10*c* is suitably secured in a loose manner to surface 40' by a suitable cable 43 through which extends an electrical cable 31*a* for energizing the circuits of dice device 10*c* in the manner heretofore described. Cables 31*a* and 43 extend through an opening 40*a* in the playing surface 40' and is secured inside of gambling machine 40 by a collar 43' formed around cable 43 which is larger in diameter than the diameter of opening 40***a*. Thus, dice device 10*c* may be randomly moved but cannot be removed from the gambling machine. Random movement of dice device 10*c* randomly changes the display on display unit as heretofore explained. The gambling machine 40 is provided with coin receiving slots 41 for placing a bet in the usual manner and trough 42 is provided for paying out the winner in coins in the usual and well known manner.

FIG. 12 illustrates a further method of randomly moving dice device 10*c*. In this modification, a right angled arm 44 is provided in the gambling machine 40 with one end extending through opening 40*a* and secured to the bottom of dice device 10*c* and the other end extending through an opening 40*b* in the gambling machine and through a collar 45 terminating in a suitable hand gripping handle or ball 44'. Thus, as arm 44 is moved by a slight rotation or jarring of ball 44', the inertia switches 21, 21' in dice device 10*c* will vary the images on the display unit 32*b* in the manner heretofore explained.

The circuit shown in FIG. 4 includes both counters 18 and 18' and decoders 26 and 26' which are currently commercially available. It should be noted that each of the counter decoder combinations can be replaced with a single integrated circuit which will produce the same result and reduce the amount of interconnecting wires to a bare minimum.

Although the specification and claims set forth two displays, it should be recognized that any dice game using one or more dice can be built to utilize the invention disclosed.

Although but a few embodiments of the invention have been illustrated and described, it will be apparent to those skilled in the art that various changes and modifications may be made therein without departing from the spirit of the invention or from the scope of the appended claims.

What is claimed is:

1. A cubic enclosure comprising:

a battery, an electronic circuit comprising a pair of counter means each having an input, a pair of single pole, single throw inertia switches, one of each interposed between the input of each of said counter means and said battery, said counter means being actuated by pulses generated in a random manner by a series of intermittent contacts occurring between the poles in said inertia switches when erratic movement is manually imparted to said enclosure, and two display surfaces on the top of said enclosure, said display surfaces each comprising exposable displays of dots positioned to represent the dots on a die, said counter means each causing a random number on each display of form one through six to be illuminated when the erratic movement ceases.

* * * * *

UNITED STATES PATENT OFFICE

CERTIFICATE OF CORRECTION

Patent No. 4,858,931 Dated August 22, 1989

Inventor(s) Ian C. McKechnie

It is certified that error appears in the above-identified patent and that said Letters Patent is hereby corrected as shown below:

Claim 1, line 18, after "of" delete "form" and substitute ---from---.

Signed and Sealed this

Fifth Day of June, 1990

*Attest:*

HARRY F. MANBECK, JR.

*Attesting Officer*

*Commissioner of Patents and Trademarks*